US007373675B2

(12) United States Patent
Thurow

(10) Patent No.: US 7,373,675 B2
(45) Date of Patent: May 20, 2008

(54) CONVERTIBLE SOFA BED

(75) Inventor: Jerry A. Thurow, Dubuque, IA (US)

(73) Assignee: Flexsteel Industries, Inc., Dubuque, IA (US)

( * ) Notice: Subject to any disclaimer, the term of this patent is extended or adjusted under 35 U.S.C. 154(b) by 0 days.

(21) Appl. No.: 10/998,233

(22) Filed: Nov. 5, 2004

(65) Prior Publication Data

US 2006/0096027 A1 May 11, 2006

(51) Int. Cl.
*A47C 17/07* (2006.01)
*A47C 17/04* (2006.01)

(52) U.S. Cl. ..... 5/37.1; 5/41; 5/927

(58) Field of Classification Search ..... 5/37.1, 5/41, 47, 48, 927
See application file for complete search history.

(56) References Cited

U.S. PATENT DOCUMENTS 4,756,034 A 7/1988 Stewart
4,937,900 A 7/1990 Bridges
5,103,510 A 4/1992 Thurow
5,414,872 A 5/1995 Kessler et al.
5,528,778 A 6/1996 Schrock et al.

*Primary Examiner*—Alexander Grosz
(74) *Attorney, Agent, or Firm*—Barnes & Thornburg LLP; David C. Brezina

(57) ABSTRACT

Disclosed is a convertible sofa bed including a seat frame, a back frame, a support structure, a first and second linkage assembly pivotally coupling the seat frame to the back frame pivotally coupling the seat frame to the support structure and pivotally coupling the back frame to the support structure, and an electrical drive assembly coupled to the first and second linkage assemblies. The electrical drive assembly includes a motor mounted to the support structure, a first and second cable drive rotatably coupled to and extending from the motor, first and second threaded drive screws having an external thread, and first and second right angle gear boxes mounted to first and second aft portions of the support structure. The electrical drive assembly also includes first and second drive nut assemblies mounted to respective first and second linkage assemblies and respective threaded drive screws.

8 Claims, 11 Drawing Sheets

CONVERTIBLE SOFA BED

BACKGROUND

This disclosure relates to sofa beds, and more particularly to a convertible sofa bed configured to be either manually operated or electrically actuated to move the sofa bed between its sofa position and its bed position.

Couch/bed combinations frequently referred to as convertible sofa beds, generally include moveable seat and back portions which can be folded to a seating configuration and unfolded to a horizontal, generally planar reclined configuration for use as a bed. Suitable linkage is provided for pivotally coupling the seat and back portions. In some sofa beds, the seat portion of the sofa unfolds outward from the back portion which remains fixed in position, with the distal end of the thus unfolded seat portion supported by unfolding legs. In others, the back portion of the sofa reclines to provide, with the seat portion, a pair of generally flat, aligned support surfaces. Other approaches make use of extendable/retractable frame extensions at either the head or foot portion of the unfolded configuration to provide additional support surface area.

To date, manually operated convertible sofa beds have suffered from various shortcomings. For example, the absence of means for locking the unfolded assembly in the bed configuration allows the flat support surface to be easily rendered non-planar when weight is concentrated on a relatively small surface area, particularly along a median axis of the bed such as between the unfolded seat and back portions thereof. In addition, convertible sofa beds which require unfolding of the seat portion by pulling up on an aft, inner portion of the seat require considerable strength for unfolding. This precludes use of this type of folding sofa bed by the handicapped, feeble or those of advancing age. Further, some available pivoting linkage for convertible sofa beds is generally complicated and makes use of a large number of components which increases its cost and reduces its reliability and limits its usable lifetime.

Similarly, electrically actuated convertible sofa beds, requiring the use of a motorized device, have suffered from various shortcomings. Besides some of the shortcomings described above, poor placement of the motorized device in some prior art electrically actuated convertible sofa beds can make repair and replacement of the motorized device difficult. For example, U.S. Pat. No. 4,321,716 to Shrock et al. discloses an electrically actuated convertible sofa bed for use in a vehicle where a drive motor is located between the seat frame and the inner wall of the vehicle in order to maximize storage space under the sofa bed. Unfortunately, such a disposition makes repair and replacement of the drive motor difficult.

SUMMARY

The convertible sofa bed disclosed herein improves on the prior art in a number of ways. Among other things, it is comfortable, simple to operate, requires a minimum number of parts given its robustness, and is easy to repair in the unlikely event that a repair is required.

In summary, the convertible sofa bed disclosed herein includes a seat frame, a back frame, a support structure, a first and second linkage assembly pivotally coupling the seat frame to the back frame, and pivotally coupling the seat frame to the support structure, and pivotally coupling the back frame to the support structure, and an electrical drive assembly coupled to the first and second linkage assemblies.

The electrical drive assembly is adapted to cause the convertible sofa bed to move in a rearward direction into a seat position and in a forward direction into a bed position.

The electrical drive assembly includes a motor mounted to the support structure, a first and second cable drive rotatably coupled to and extending from the motor, first and second threaded drive screws having an external thread, and first and second right angle gear boxes mounted to first and second aft portions of the support structure. Each of the first and second right angle gear boxes has a first input rotatably coupled to its respective cable drive and a second input rotatably coupled to a first end of its respective threaded drive screw, the first and second right angle gear boxes responsive to the motor to rotate the first and second threaded drive screws in a substantially horizontal plan. The electrical drive assembly also includes first and second drive nut assemblies associated with respective first and second threaded drive screws, where each of the first and second drive nut assemblies is mounted to its respective linkage assembly and respective threaded drive screw. Each of the first and second drive nut assemblies is adapted to linearly travel on its threaded drive screw to cause movement of first and second linkage assemblies in response to rotation of the first and second threaded drive screws, thereby moving the convertible sofa bed in a forward and rearward direction.

Advantages of the convertible sofa bed disclosed herein include simple yet reliable and sturdy linkage assemblies that provide numerous advantages over previous convertible sofa bed designs. In addition, due to the placement and design of the linkage assemblies, a manufacturer can easily convert a manually actuated convertible sofa bed to an electrically actuated convertible sofa bed 10*b*. Further, full length sinuous wire springs in both the back and seat frames provide optimum comfort and support, while the large surface area provided when the convertible sofa bed 10 is in the bed position provides sleeping comfort.

Other objects, advantages and novel features of the present disclosure will become apparent from the following detailed description when considered in conjunction with the accompanying drawings.

DETAILED DESCRIPTION

Figure 1:
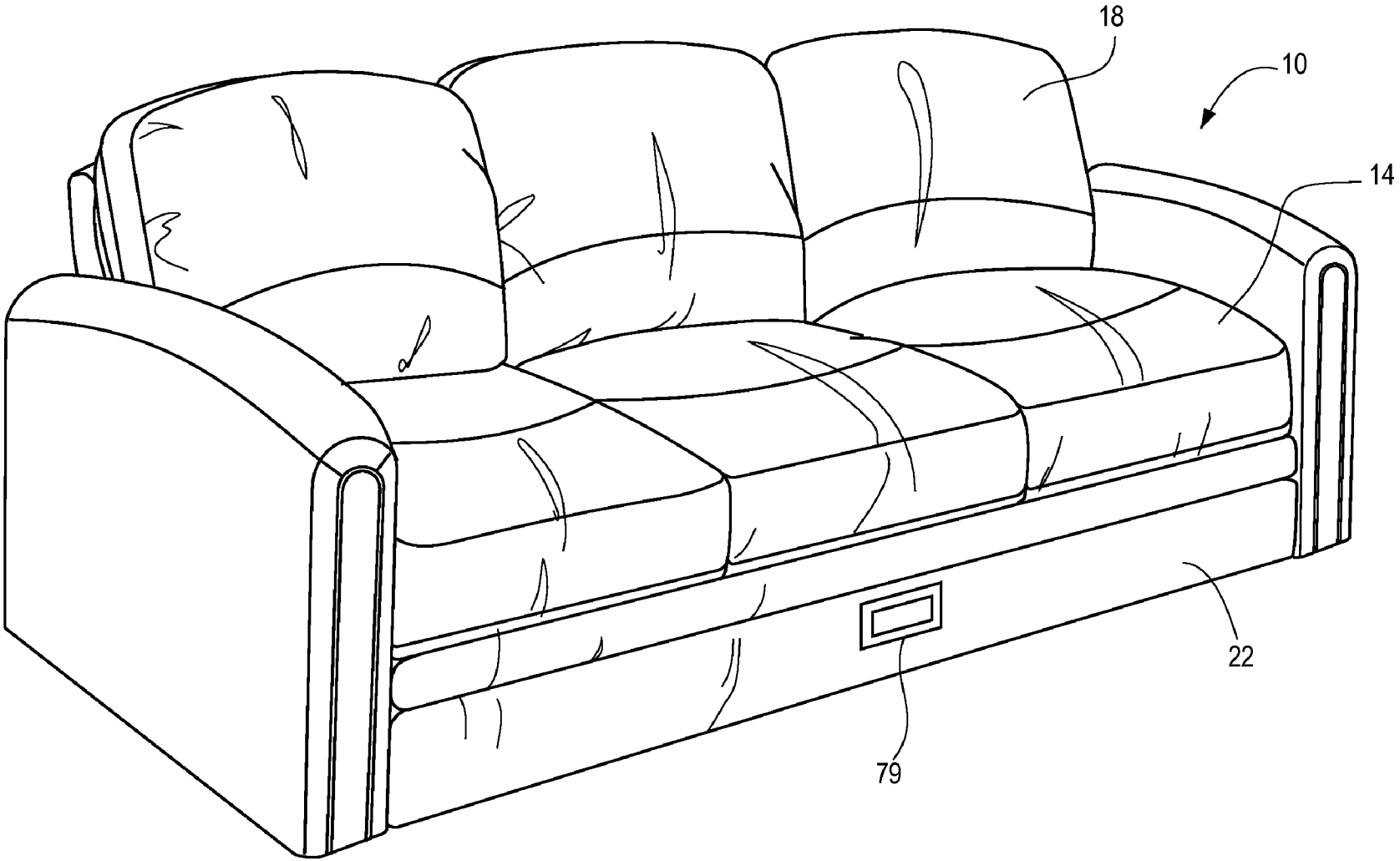
FIG. 1 is a top, front view of an upholstered convertible sofa bed in accordance with an embodiment of the invention.

While the present disclosure may be susceptible to embodiment in different forms, there is shown in the drawings, and will be described herein in detail, one or more embodiments with the understanding that the present description is to be considered an exemplification of the principles of the disclosure and is not intended to be exhaustive or to limit the disclosure to the details of construction and the arrangements of components set forth in the following description or illustrated in the drawings.

FIG. 1 is a top, front view of a convertible sofa bed 10 in accordance with an embodiment of the invention. As described in detail below, the convertible sofa bed 10 may be configured as either a manually actuated or electrically actuated convertible sofa bed. FIGS. 2-6 describe a manually actuated convertible sofa bed 10*a* while FIGS. 9-12 describe an electrically actuated convertible sofa bed 10*b*. The convertible sofa bed includes a seat cushion 14 having an associated seat frame 16 (see, FIG. 2), a back cushion 18 having an associated back frame 20 (see, FIG. 2), a front kick panel 22 having an associated drawer-like front kick panel frame 24, and a support structure 26 (see, FIG. 2). The front kick panel 22 includes a rigid panel, preferably plywood, suitable foam material disposed on a front surface of the rigid panel, and suitable upholstery covering the foam material and affixed to a back surface of the rigid panel.

When in the sofa configuration as shown in FIG. 1, the seat cushion 14 is generally horizontal, and the back cushion 18 and front kick panel 22 are generally vertical. Although configured with the front kick panel 22 and associated front kick panel frame 24 to provide aesthetically pleasing and easily accessible storage, it is contemplated that the convertible sofa bed 10 may be configured without them.

Figure 2:
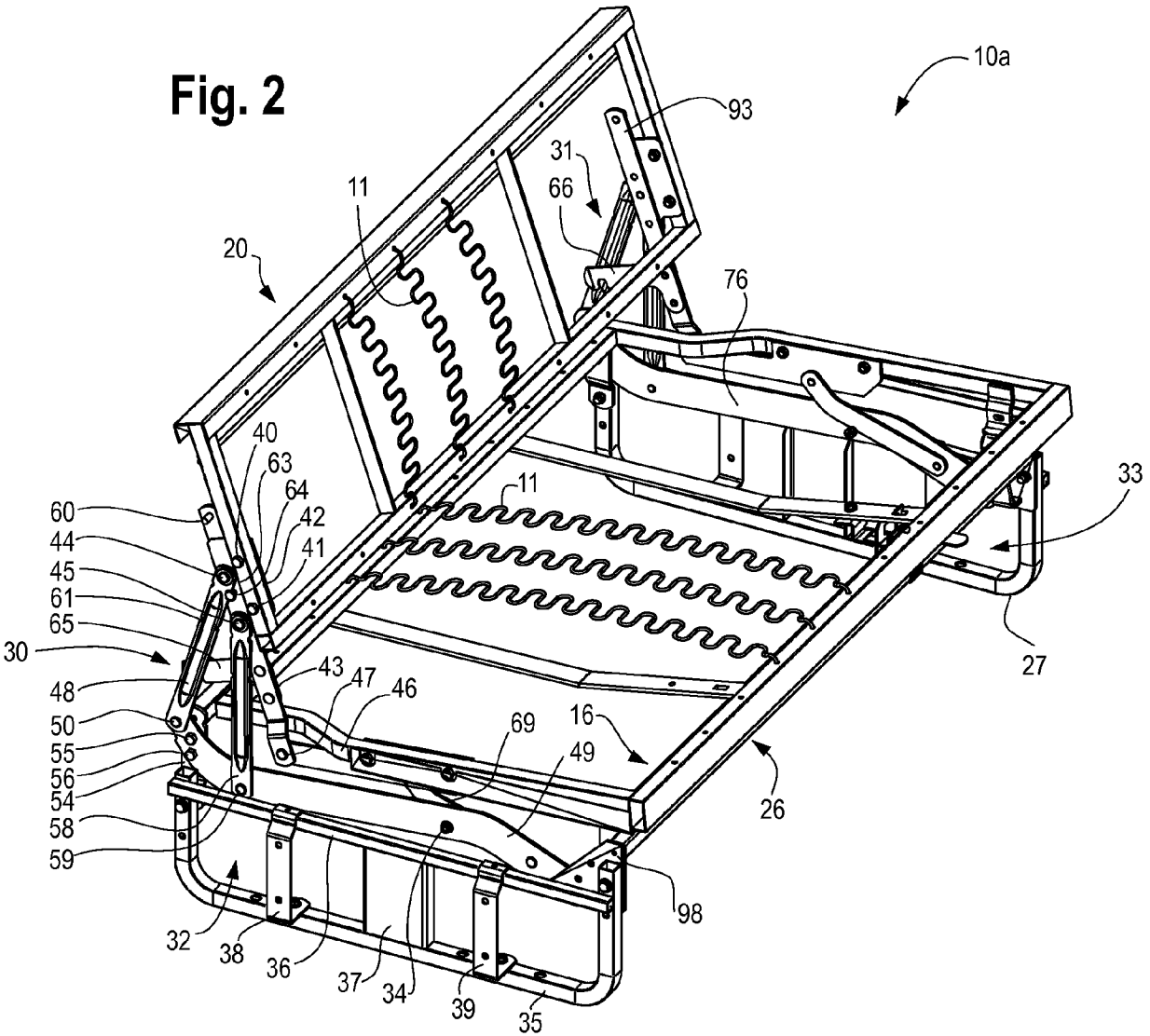
FIG. 2 is a top, side perspective view of the frame members and linkage of a manually actuated convertible sofa bed in the seat position in accordance with an embodiment of the invention.

FIG. 2 is a top, side perspective view of the frame members and linkage of a manually actuated convertible sofa bed 10*a* in the seat position in accordance with an embodiment of the invention. As shown in FIG. 2, the seat frame 16 is provided for supporting the seat cushion 14 while the back frame 20 is provided for engaging and supporting the back cushion 18. In one embodiment, in the seat position, the seat frame is 52 inches from the first side to the second side and 28.75 inches from the front to the back, and the back frame is 52 inches from the first side to the second side and 14.5 inches from the top to the bottom. Thus, when in the bed position, the convertible sofa bed 10 is 42.25×52 inches in length. It is contemplated that other suitable dimensions for the convertible sofa bed 10 are possible, depending on the desired footprint and bed dimensions.

The front kick panel frame 24 is configured in a drawer-like arrangement where the front of the drawer-like arrangement provides an attachment point for the front kick panel 22. Each of the aforementioned seat, and back extension frames 16, 20 is moveable relative to one another for assuming either the seat configuration of FIG. 1 or the bed configuration (see, FIG. 3) where the each of the frame members are aligned in a generally planar array as described in detail below.

In addition to at least two cross-members, support for the seat cushion 14 is provided by a number of sinuous wire springs 11 (i.e., a number of sinusoidally shaped wire springs) having ends affixed to opposing fore and aft seat frame members of the seat frame 16. Similarly, in addition to at least two cross-members, the back frame 20 includes a number of sinuous wire springs 11 having ends affixed to opposing top and bottom back frame members of the back frame 20. Such "full length" sinuous wire springs of the convertible sofa bed 10 provide optimal support and comfort, and are superior to "partial length" springs or rods used in other convertible sofa beds.

The seat frame 16 is moveably coupled to the back frame 20 and the support structure 26 via a first linkage assembly 30 and second linkage assembly 31 where each of the first and second linkage assemblies 30, 31 is mirror identical. Although both of the first and second linkage assemblies 30, 31 are illustrated in the Figures, only the first linkage assembly 30 connecting one end of the seat and back frames 16, 20 is described in detail, it being understood that the second linkage assembly 31 similarly connects the other end of the seat and back frames 16, 20.

Referring to FIG. 2, the support structure 26 includes a first leg assembly 32 extending downward from a first side of the seat frame 16, and a second leg assembly 33 extending downward from a second side of the seat frame 16. Although both of the first and second leg assemblies 32, 33 are illustrated in the Figures, only the first leg assembly 32 is described in detail, it being understood that the second leg assembly 33 is similarly constructed and operable.

The first leg assembly 32 includes a generally U-shaped leg 35 extending downward from a first side of the seat frame 16, a stiffener member 36 fixedly coupled to top portions of the U-shaped leg 35 and extending between the front and back of the seat frame 16. The first leg assembly 32 also includes a channel member 37 extending vertically between the stiffener member 36 and a bottom portion of the U-shaped leg 35 at a midpoint between the front and back of the seat frame 16, and an optional first and second arm mounting bracket 38 and 39, each positioned on either side of the channel member 37 and extending vertically between the stiffener member 36 and a bottom portion of the U-shaped leg 35. When utilized, the arm mounting brackets 38 and 39 provide a mounting location for sofa arms, depending on the convertible sofa bed design.

The first linkage assembly 30 includes a first back carrier link 43, a seat mounting bracket 46, a base link 49 extending between a fore and aft portion of a first side of the support structure 26 proximate to the stiffener member 36, a first and second pivoting backlink 48, 58, a seat coupling bracket 69 and a notched latch bracket 68.

The first back carrier link 43 is attached to a first side of the back frame 20 via a back mounting bracket 42 by means of a pair of mounting bolts 40 and 41. The back mounting bracket 42 is, in turn, coupled to the first back carrier link 43 by means of coupling pivot pins 44 and 45. The coupling pivot pins 44, 45 rigidly attach the back frame 20 and back mounting bracket 42 combination to the first back carrier link 43. One end of the first back carrier link 43 is coupled to seat a mounting bracket 46 of the seat frame 16 via a pivot pin 47. The seat mounting bracket 46 is rigidly attached to the seat frame 16 by conventional means known in the art. The pivot pin 47 permits the back frame 20 to be pivotally displaced relative to the seat frame 16.

The back mounting bracket 42 is also coupled by means of the coupling pin 44 to one end of the first pivoting backlink 48. The other end of the first pivoting backlink 48 is pivotally coupled to the aft end of a first base link 49 by means of a pivot pin 50. A latch pin 34 is configured as a bolt and roller assembly and is disposed on the first base link 49. The latch pin 34 provides a latching point when the convertible sofa bed is moved to the bed position. An aft portion of the first base link 49 is fixedly attached to an aft portion of the U-shaped leg 35 by a rear spacer bracket 54 and bolts 55 and 56. The back mounting bracket 42 is further pivotally coupled to one end of the second pivoting backlink 58 by means of the coupling pivot pin 45. A second end of the second pivoting backlink 58 is pivotally coupled to the first base link 49 by means of a pivot pin 59.

Figure 3:
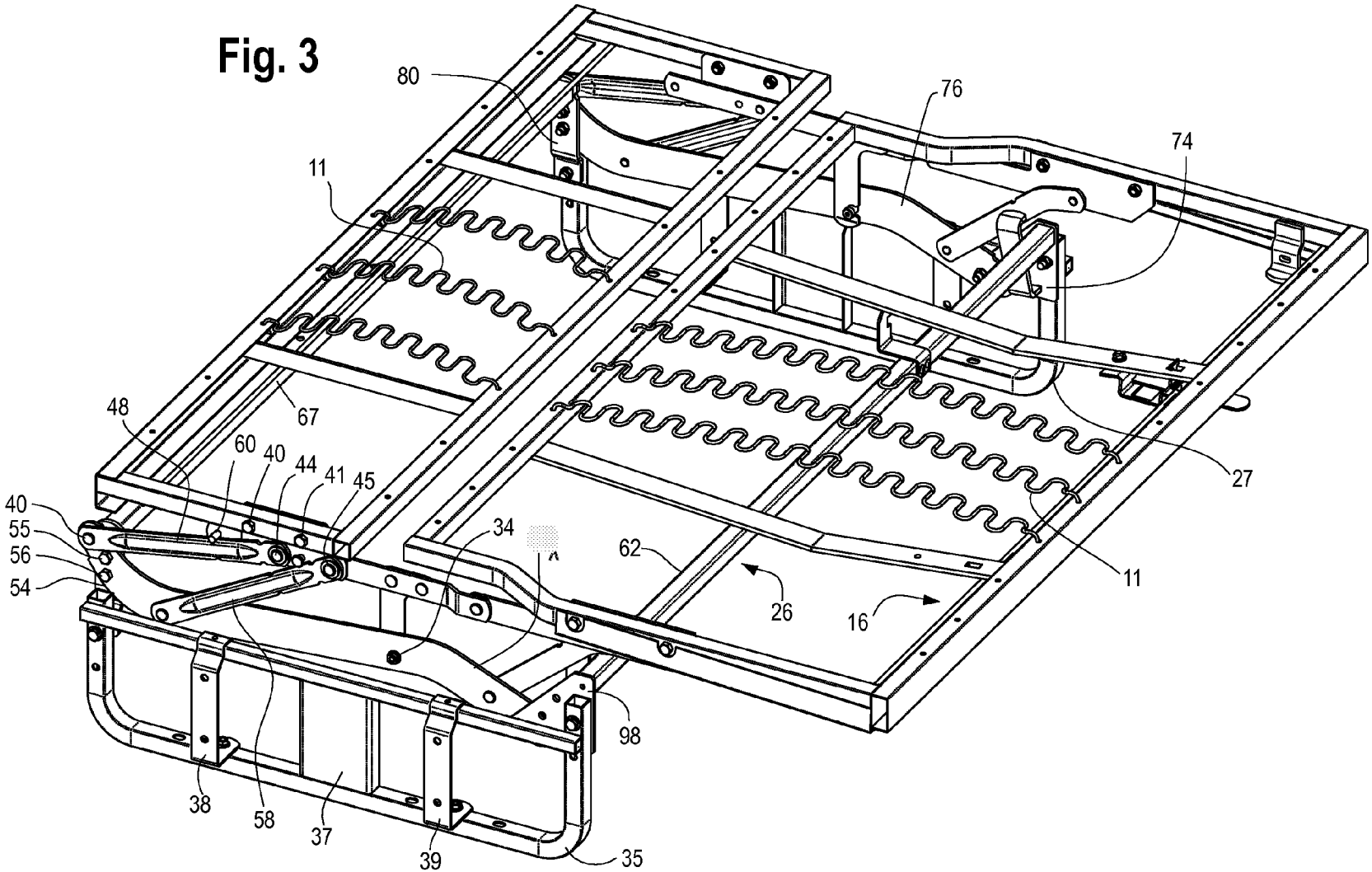
FIG. 3 is a top, side perspective view of the frame members and linkage of the manually actuated convertible sofa bed of FIG. 2 in the bed position.
Figure 4:
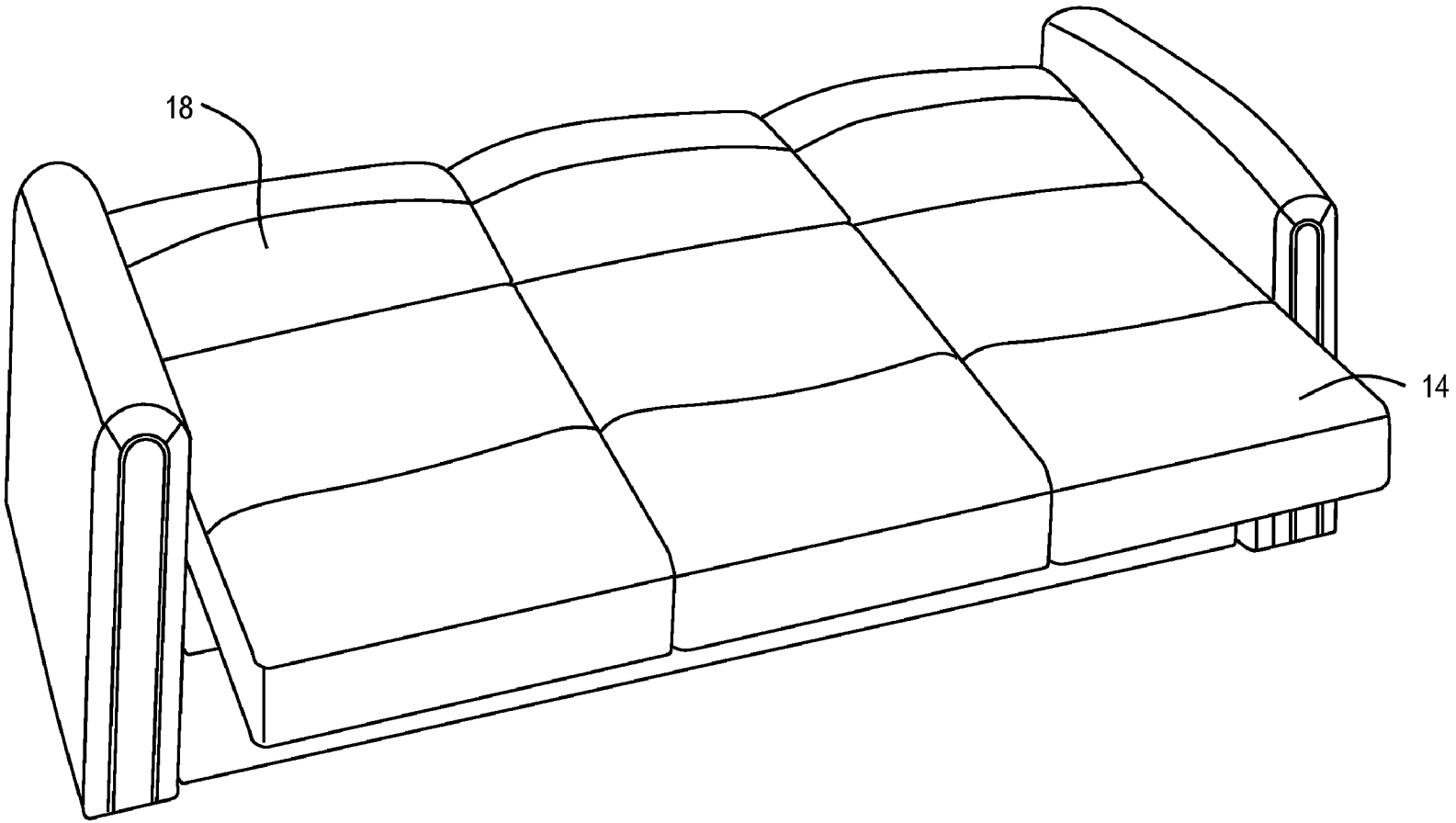
FIG. 4 is a top, front perspective view of the upholstered convertible sofa bed of FIG. 1 in the bed position.

A combination of the first and second pivoting backlinks 48, 58 pivotally coupled to the back frame 20 and back mounting bracket 42 combination permits the back frame 20 to be pivotally displaced downward relative to the first base link 49 as shown in FIG. 3 where FIG. 3 is another view of the convertible sofa bed 10*a*, unupholstered, in the bed position.

Referring again to FIG. 2, a seat coupling bracket 69 has a first end pivotally coupled to the seat mounting bracket 46 and a second end pivotally coupled to the base link 49. The seat coupling bracket 69 also includes a notch (not separately illustrated) configured to receive the latch pin 34 when the convertible sofa bed 10 is in the seat position. The seat coupling bracket 69 is adapted to enable forward and rearward movement of the seat frame 16. During manual operation between the seat and bed positions, the first end of the seat coupling bracket 69 pivots around the second end of the seat mounting bracket 46 in an arc fashion to enable the forward and rearward movement.

Figure 5:
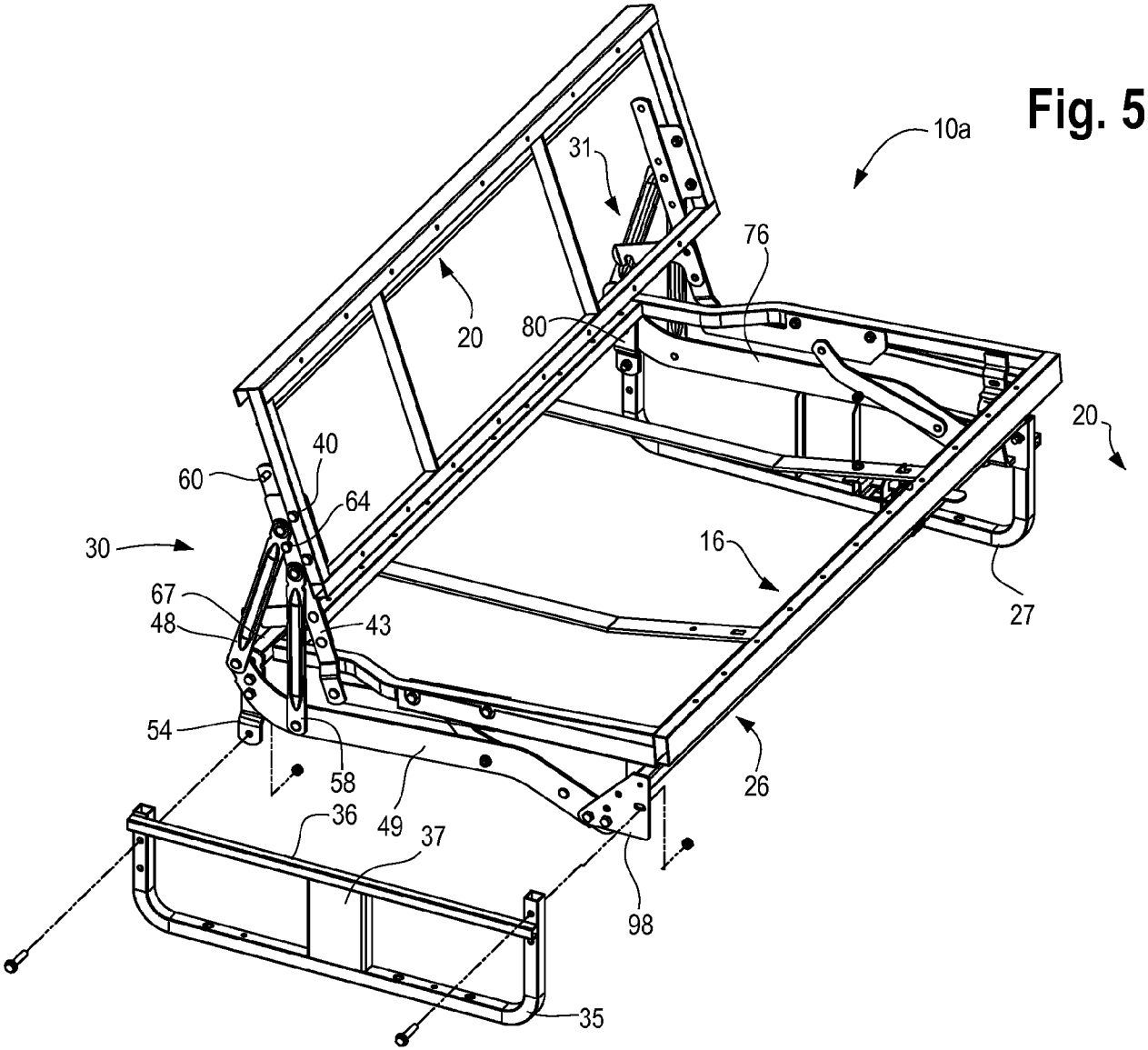
FIG. 5 is a partially exploded top, side perspective view of the manually actuated convertible sofa bed of FIG. 2 illustrating the coupling between the base link and the front and rear horizontal spacer tube assemblies.

FIG. 3 is a top, side perspective view of the frame members and linkage of the manually actuated convertible sofa bed of FIG. 2 in the bed position. As illustrated, the support structure 26 also includes a front horizontal spacer tube assembly 62 having a first end coupled to a fore portion of the first base link 49 and the U-shaped leg 35 via a triangular bracket 98 and a bolt arrangement, and a second end coupled to a fore portion of a second base link 76 and a U-shaped leg 27 via a triangular bracket 74 and a bolt arrangement. For example, FIG. 5 is a partially exploded side perspective view of the manually actuated convertible sofa bed 10*a* illustrating the coupling between the first base link 49, the U-shaped leg 27 and the triangular bracket 98.

Similarly, the support structure 26 includes a rear horizontal spacer tube assembly 67 (see also, FIG. 5) having a first end coupled to the aft portion of the first base link 49 and the U-shaped leg 35 via the rear spacer bracket 54 and a bolt arrangement, and a second end coupled to an aft portion of the second base link 76 and the U-shaped leg 27 via a rear spacer bracket 80 and a bolt arrangement. Each of the front horizontal spacer tube assembly 62 and the rear horizontal spacer tube assembly 67 provide a structural interface between the linking mechanisms (e.g., the carrier links, the pivoting back links, etc.) and the first and second leg assemblies of the manually actuated convertible sofa bed 10.

During operation of the convertible sofa bed 10*a*, as the upper edge of back frame 20 is pivotally displaced rearward and urged in a downward direction, the first back carrier link 43 urges the seat frame 16 in a forward direction, or rightward as shown in FIG. 2. As the back frame 20 is pivotally rotated about the pivot pin 47 in a counter-clockwise direction, the first and second pivoting backlinks 48 and 58 are rotated in a clockwise direction about pivot pins 50 and 59, respectively. In the bed configuration, the first pivoting backlink 48 is oriented generally horizontal as illustrated by FIG. 3.

Figure 6:
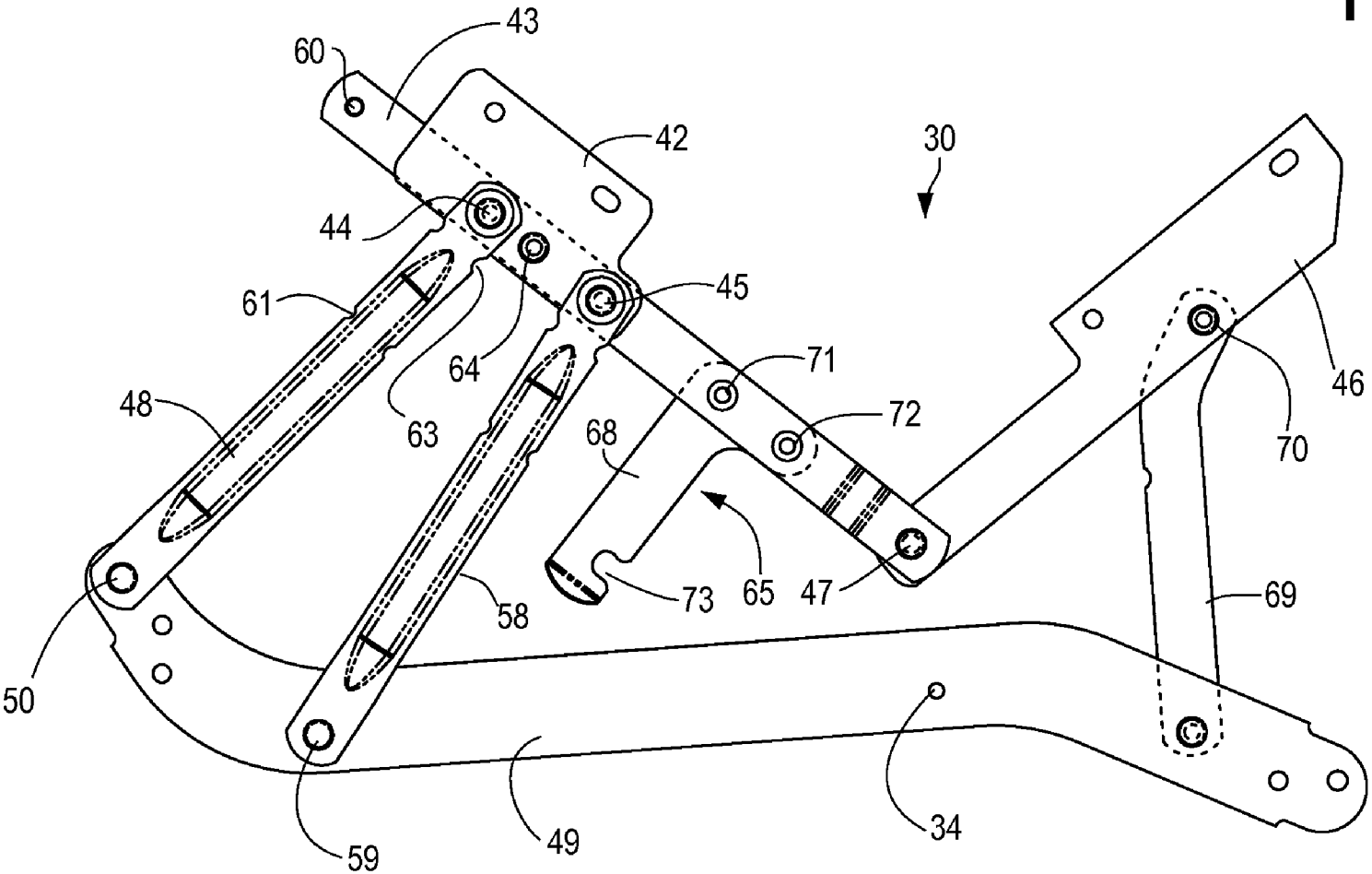
FIG. 6 is a side elevation view of a portion of the first linkage assembly of the convertible sofa bed of FIG. 2 in an intermediate position.

Referring again to FIG. 2, an upper end portion of the first back carrier link 43 is provided with a stop pin 60 for insertion in a first notch 61 in an edge portion of the first pivoting backlink 48 when in the bed configuration (see also, FIG. 6). Thus, as the back frame 20 is lowered to the reclined position, clockwise rotation of the first pivoting backlink 48 and counter-clockwise rotation of the first back carrier link 43 causes the stop pin 60 to be positioned within the first notch 61 of the first pivoting backlink 48. With the first back carrier link 43 and the first pivoting backlink 48 oriented generally horizontally, the stop pin 60 is positioned within and engages the first notch 61 in the first pivoting backlink 48 to limit further downward movement of the back frame 20.

The first pivoting backlink 48 is provided with a second notch 63 which is located adjacent the upper end thereof when the convertible sofa bed 10*a* is in the sofa configuration. The second notch 63 is adapted for receiving and engaging a stop pin 64 attached to the first back carrier link 43. Engagement by the stop pin 64 of the second notch 63 in the first pivoting backlink 48 prevents aft displacement of the back frame 20 for securely maintaining the convertible sofa bed 10 in the upright, sofa configuration shown in FIGS. 1 and 2.

A first and second bed locking arrangement 65 and 66 is provided for maintaining the back and seat frames 20, 16 securely in position when in the bed configuration. Although both are illustrated in FIG. 2, only the first bed locking arrangement 65 is described in detail, it being understood that the second bed locking arrangement 66 is a mirror image of the first bed locking arrangement 65.

FIG. 6 is a side elevational view of a portion of the first linkage assembly 30 of the convertible sofa bed of FIG. 2 in an intermediate position. The first locking arrangement 65 includes an notched latch bracket 68 fixedly attached to the first back carrier link 43 (mirror configured and operational as the second back link carrier 93) by means of mounting pins 71 and 72. The notched latch bracket 68 includes a notch 73 therein for receiving and engaging the latch pin 34 attached to a portion of the associated first base link 49. The location of the latch pin 34 is selected such that insertion of the latch pin 34 in the notch 73 of the notched latch bracket 68 securely maintains the back frame 20 and seat frame 16 in generally horizontal alignment as shown in FIG. 3 when in the bed configuration. Accordingly, forward displacement of the seat frame 16 causes a corresponding forward displacement of the notched latch bracket 68 until the notch 73 engages the latch pin 34, while rearward displacement of the seat frame 16 causes a corresponding rearward displacement of the notched latch bracket 68 which is thereby disengaged from the latch pin 34 for unlocking the convertible sofa bed 10 and allowing the convertible sofa bed 10*a* to be folded to the upright, sofa configuration.

As described above, the first and second pivoting backlinks 48 and 58 are attached to the back mounting bracket 42 via coupling pivot pins 44 and 45, respectively, and pivotally coupled to the first base link 49 via pivot pins 50 and 59, respectively. As also illustrated, the seat mounting bracket 46 is pivotally coupled to the first back carrier link 43 via the pivot pin 47, and pivotally coupled to the seat coupling bracket 69 via pivot pin 70.

Figure 7:
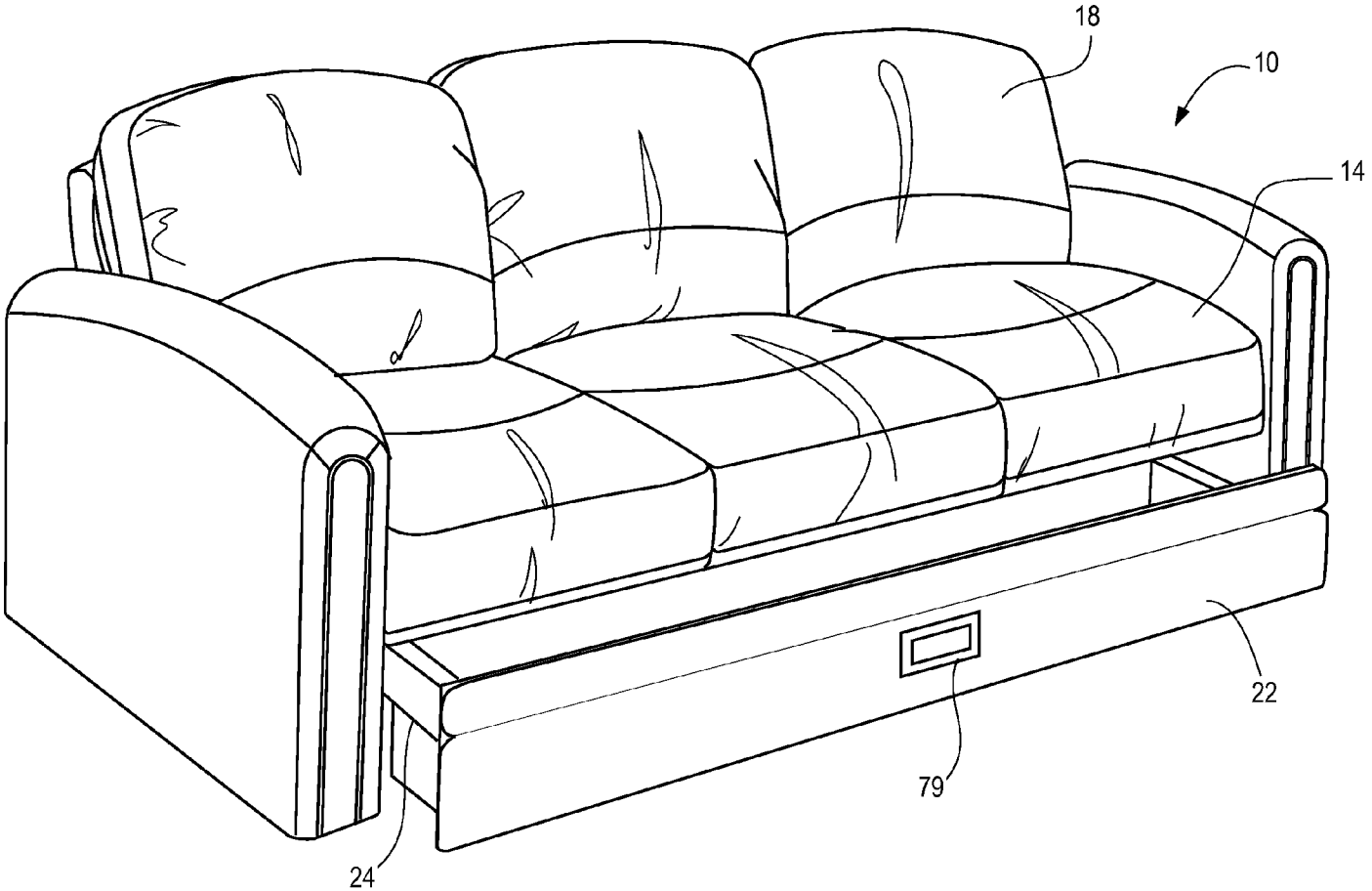
FIG. 7 is a top, front perspective view of the upholstered convertible sofa bed of FIG. 1 with the storage extension and kick panel in the open position.

As mentioned above, the manually actuated convertible sofa bed 10*a* includes drawer-like front kick panel frame 24 and an associated front kick panel 22 mounted on the front of the extension frame in a generally vertical direction. When in a closed position (see, FIG. 1), the front surface of the front kick panel 22 is generally aligned with the front of the seat frame 16, giving the appearance of a typical upholstered sofa. A handle 79 is provided to enable access to storage space below the convertible sofa bed 10. Accordingly, the user may gain access to the storage space upon actuating the handle (e.g., squeezing the handle) and then pulling the front kick panel frame 24 forward. FIG. 7 is a top, front perspective view of the upholstered convertible sofa bed of 10 with the storage extension and front kick panel 24 in the open position to reveal storage space.

Figure 8:
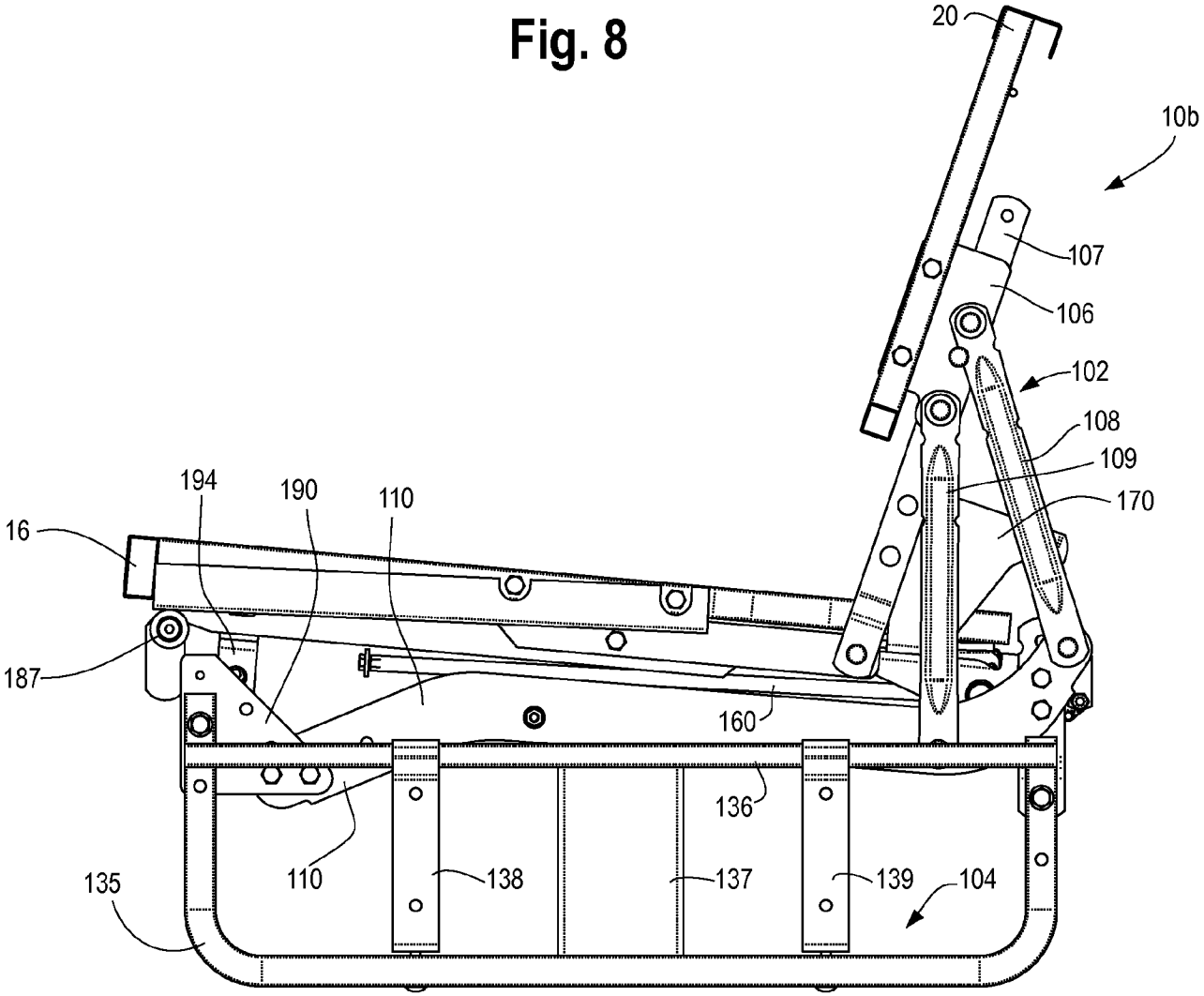
FIG. 8 is a side elevation view of the frame members and linkage of an electrically actuated convertible sofa bed in the seat position in accordance with an embodiment of the invention.

In addition to manual actuation, the convertible sofa bed 10 may also be configured as an electrically actuated convertible sofa bed 10*b*. FIG. 8 is side view of the frame members and linkage of the electrically actuated convertible sofa bed 10*b* in the seat position in accordance with an embodiment of the invention. Like the manually actuated convertible sofa bed 10*a*, the electrically actuated convertible sofa bed 10*b* includes a seat frame 16, a back frame 20, a first linkage assembly 102 and second linkage assembly 103 (see also, FIGS. 9 and 10) moveably coupling the seat and back frames 16, 20, respectively, and a first leg assembly 104 and a second leg assembly 105 extending downward from each side of the seat frame 16.

Like the manually actuated convertible sofa bed 10*a*, the first linkage assembly 102 includes, inter alia, a back mounting bracket 106 coupling a first back carrier link 107 to an exterior portion of a first side edge of the seat frame 16, a first and a second pivoting backlink 108 and 109 pivotally coupling the first back carrier link 107 to a first base link 110. The second linkage assembly 103 includes, inter alia, a back mounting bracket 120 coupling a second back carrier link 118 to an exterior portion of a side second edge of the seat frame 16, a first and a second pivoting backlink 122 and 123 pivotally coupling the second back carrier link 118 to a second base link 125. Both the first and second linkage assemblies 102, 103 are similarly constructed and operable as the linkage assemblies of the manually actuated convertible sofa bed 10*a*.

Figure 9:
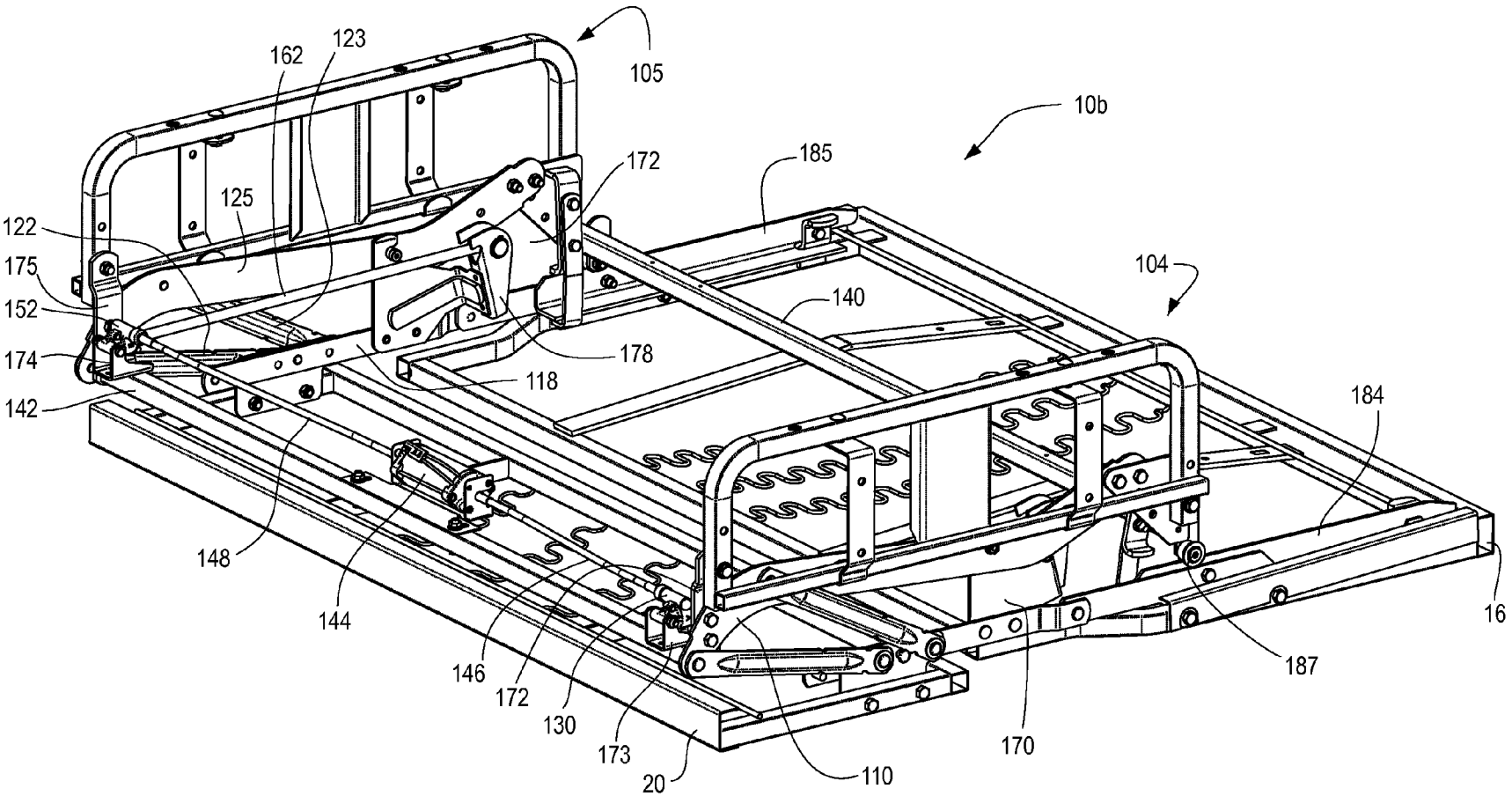
FIG. 9 is an inverted bottom, side perspective view of the frame members and linkage of an electrically actuated convertible sofa bed of FIG. 8 in the bed position.
Figures 10, 11:
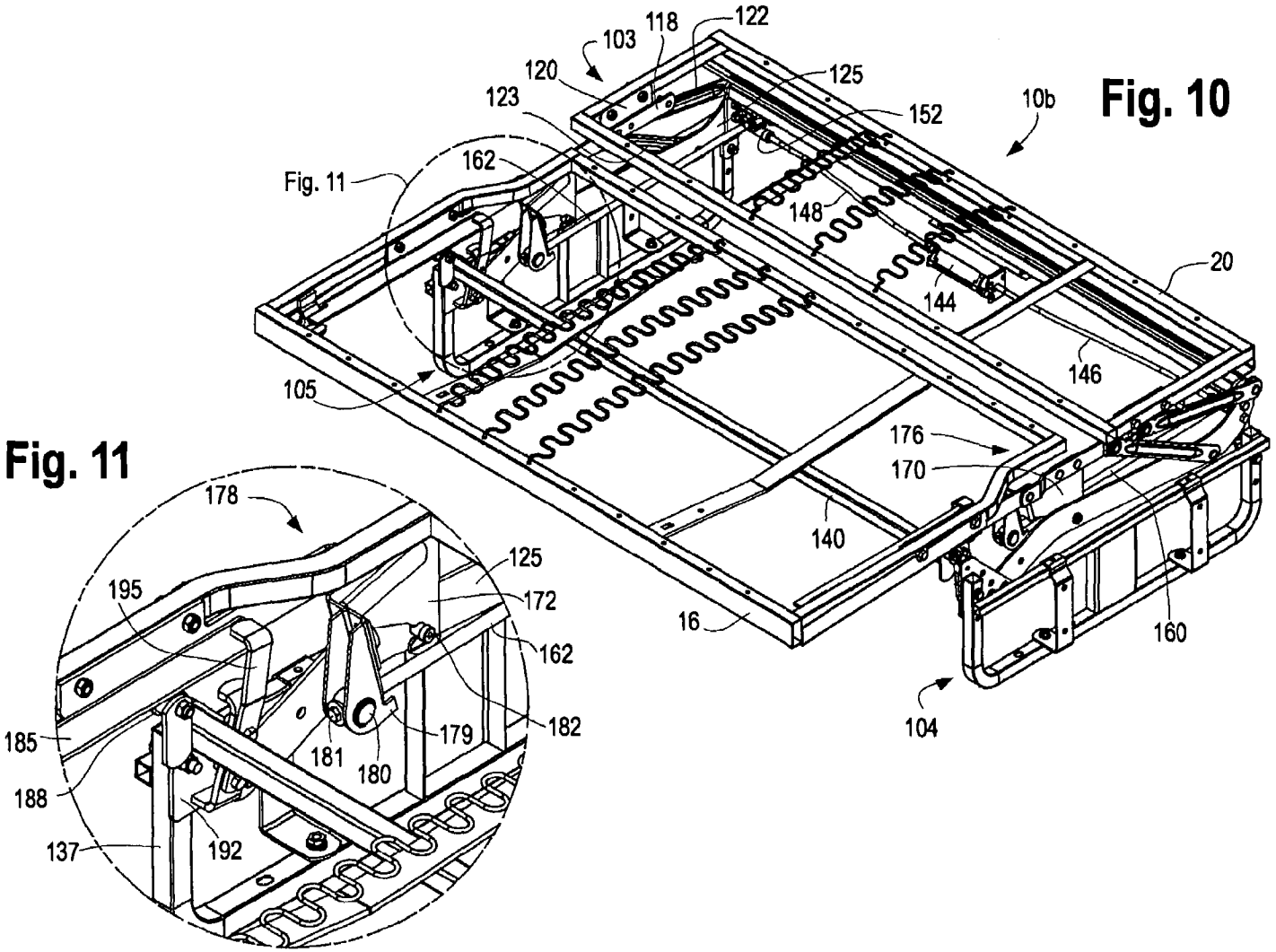
FIG. 10 is a top, side perspective view of the frame members and linkage of an electrically actuated convertible sofa bed of FIG. 8 in the bed position.
FIG. 11 is an enlarged perspective view of the pivot mechanism in FIG. 10.

Referring to FIGS. 8, 9 and 10, a first and a second notched latch bracket 170 and 172, operating much like the notched latch bracket 68 described in connection with FIG. 2, are fixedly coupled to an interior lower portion of respective first and second back carrier links 107, 118. In addition to maintaining the back and seat frames 20, 16 securely in position when in the bed configuration, an upstanding flange on each of the first and second notched latch brackets 170, 172 provides a mounting surface for respective drive nut assemblies (discussed below).

Similar to the manually actuated convertible sofa bed 10*a*, the first leg assembly 104 includes, inter alia, a generally U-shaped leg 135 extending downward from the first side of the seat frame 16, a stiffener member 136 fixedly coupled to top portions of the U-shaped leg 135 and extending between the fore and aft edges of the U-shaped leg 135, a channel member 137 extending vertically between the stiffener member 136 and a bottom portion of the U-shaped leg 135, preferably at a midpoint between the fore and aft edges of the U-shaped leg, and an optional first and second arm mounting bracket 138 and 139, each positioned on either side of the channel member 137 and extending vertically between the stiffener member 136 and a bottom portion of the U-shaped leg 135, all similarly constructed and operable as the leg assemblies of the manually actuated convertible sofa bed 10*a*.

Unlike the manually actuated convertible sofa bed 10*a*, the electrically actuated convertible sofa bed 10*b* first, does not include seat coupling brackets (e.g., the seat coupling bracket 69), second, includes modifications to elements of the manually actuated convertible sofa bed 10*a*, for example, modifications to front and rear spacer tube assemblies 140 and 142 (see, FIG. 9), and third, includes additional elements described below, all of which together enable electric actuation of the convertible sofa bed 10*b* between the seat position, the bed position, and a reclining upright position.

For example, referring to FIG. 9, the electrically actuated convertible sofa bed 10*b* includes a motor 144, for example, a 12 VDC permanent magnet motor 144 manufactured by Arkansas General Industries. The motor 144 is mounted to a middle portion the rear spacer tube assembly 142 via one of any number of well known mounting brackets and screw assembly configurations. The location of the motor 144 is preferably selected to enable maximum storage space below the seat 16 while at the same time, allowing optimal accessibility to the motor 144 for maintenance and repair, should the need arise. As illustrated in FIGS. 9 and 10, two cable drives 146 and 148, are rotatably coupled to the motor 144. Each of the cable drives 146, 148 extend from the motor 144 along the rear spacer tube assembly 142 in opposite directions to a first and second right-angle gear box 150 and 152, respectively. Each of the first and second right-angle gear boxes 150 and 152 may be suitable right-angle gear boxes manufactured by Smith Richards, Inc. Although configured using cable drives 146 and 148, it is contemplated that the electrically actuated convertible sofa bed 10*b* may instead be configured using rigid members for synchronized rotation.

The first gear box 150 is mounted to an aft portion of the first base link 110 via a U-shaped mounting bracket 173 and first rear spacer bracket 172, the first rear spacer bracket 172 coupling the first leg assembly 104 to the first base link 110. Likewise, the second gear box 152 is mounted to an aft portion of the second base link 125 via a U-shaped mounting bracket 174 and second rear spacer bracket 175, the second rear spacer bracket 175 coupling the second leg assembly 105 to the second base link 125 (see also, FIG. 12).

The first right angle gear box 150 is responsive to the motor 144 to rotate, in a substantially horizontal plane substantially parallel to the first base link 110, a first threaded drive screw 160. Similarly, the second right angle gear box 152 is responsive to the motor 144 to rotate, in a substantially horizontal plane substantially parallel to the second base link 125, a second threaded drive screw 162, where rotation of the second threaded drive screw 162 is in synchronous with the first threaded drive screw 160. Accordingly, a first end of each of the first and second threaded drive screws 160, 162 is rotatably coupled to respective right angle gear boxes 150, 152 to rotate, either clockwise or counter-clockwise, during operation of the motor 144. Although right-hand threaded screw drives having acme threading are preferably used, it is contemplated that other suitably configured drive screws may be utilized in the electrically actuated convertible sofa-bed 10*b*.

The electrically actuated convertible sofa bed 10*b* includes first and second drive nut assemblies 176 and 178 fixedly mounted to respective flanges of the first and second latch brackets 170, 172. FIG. 10 is a top, side perspective view of the frame members and linkage of an electrically actuated convertible sofa bed 10*b* in the bed position, showing the second drive nut assembly 178 in detail, it being understood that the first drive nut assembly 176 is a mirror image of the second drive nut assembly 178. As illustrated, the first and second drive nut assemblies 176 and 178 are operationally coupled to respective first and second back link carriers 107 and 118 rather than the seat frame 16, thereby precluding the need to manufacture differently designed seat frames for the electrical and manual versions of the convertible sofa bed.

Referring to FIG. 10 and 11, the drive nut assemblies 176, 178 are mirror images on either side of the bed 10*b*. FIG. 11 is an enlarged view of the second drive nut assembly 178 which will be described in detail as the enlargement and angle of the view provides a better view of the structure. Assembly 178 includes a drive nut clevis 179 having a top portion mounted to the flange of the second notched latch bracket 172 and having a bottom portion configured to allow the second threaded drive screw 162 to pass between opposing sides of the second drive nut clevis 179 during forward and rearward motion of the seat 16. An aperture in each of the opposing sides of the drive nut clevis 179 is configured to receive a drive nut 180 having a crosswise threaded bore therein. The crosswise threaded bore of the drive nut 180 is configured to receive the second threaded drive screw 162. Although preferably a one and one-half inch round drive nut having a seven-eighths inch diameter, the drive nut 180 may be one of any number of other suitable shape and/or dimensions, depending on the design.

During operation of the electrically actuated convertible sofa bed 10*b* from the seat position to the bed position, clockwise rotation of the second threaded drive screw 162 in the crosswise threaded bore of the drive nut 180 causes the second notched latch bracket 172 to travel in a forward direction, thus translating rotational movement of the second threaded drive screw into linear movement of the second drive nut assembly 178 and the second notched latch bracket 172. Similarly, synchronous clockwise rotation of the first threaded screw drive 160 causes the second notched latch bracket 172 to travel in the forward direction. In response, a bottom portion of the second back carrier link 118 is pivotally displaced in the forward direction, thereby urging an upper edge of the back frame 20 in a rearward and downward direction. The second drive nut clevis 179 continues to "pull" the second notched latch bracket 172 (coupled to the second back carrier link 118) and the first drive nut clevis of the first drive nut assembly 176 continues to pull the first notched latch bracket 170 (coupled to the first back carrier link 107) into the forward direction until their respective drive nuts (e.g., the drive nut 180) contact respective washer and bolt assemblies (e.g., a washer and bolt assembly 181) disposed on the second end of their respective threaded drive screws. The seat frame 16 is therefore pulled in the forward direction.

Upon reaching the end of forward direction travel, a latch pin 182, disposed on an interior portion of the second base link 125 captures the notch of the second notched latch bracket 172 (see, FIGS. 10, 11 and 12), thereby locking the electrically actuated convertible sofa bed 10*b* into the bed position and enabling optimal weight distribution and stability via load transfer to the second base link 125. Although the latch pin 182 is preferably constructed using a bolt and roller disposed around the perimeter of the bolt to enable easy engaging and disengaging of the second notched latch bracket 172, it is contemplated that one of any number of suitable bolt arrangements may be utilized.

During operation of the electrically actuated convertible sofa bed 10*b* from the bed position to the seat position, counter-clockwise rotation of the second threaded drive screw 162 in the crosswise threaded bore of the drive nut 180 causes the second latch bracket 172 to travel in a rearward direction. Likewise, synchronous counter-clockwise rotation of the first threaded drive screw 160 causes the first latch bracket 170 to travel in a rearward direction. In response, bottom portions of the first and second back links are pivotally displaced in the rearward direction, thereby urging the upper edge of the back frame 20 in a forward and upward direction, and causing the notch of the first and second notched latch bracket 170, 172 to be released from their respective latch pins.

The seat frame 16 is pulled in the rearward direction as the second drive nut clevis 179 pulls the second notched latch bracket 172 into the rearward direction and the first drive nut clevis of the first drive nut assembly 176 pulls the first notched latch bracket 170 into the rearward direction. Travel continues until the respective drive nuts (e.g., the drive nut 180) of each of the first and second drive nut assemblies 176 and 178 contact the first ends of their respective threaded drive screws 160, 162.

Figure 12:
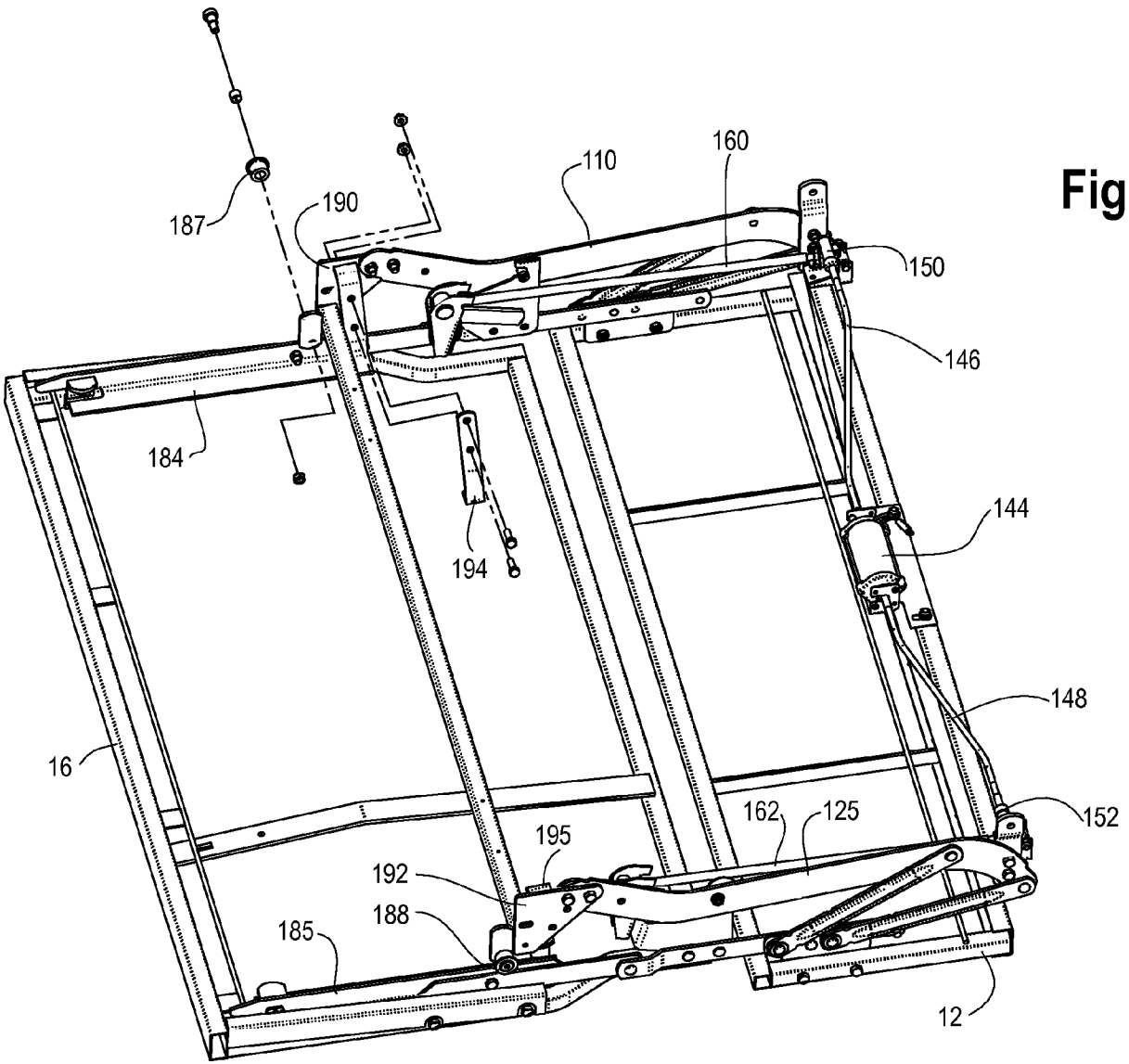
FIG. 12 is an inverted, side perspective view of electrically actuated convertible sofa bed of FIG. 8 in the bed position illustrating the rollers and stop/retainer brackets.

FIG. 12 is an inverted bottom, side perspective view of electrically actuated convertible sofa bed of FIG. 8 in the bed position illustrating the rollers and stop/retainer brackets. The electrically actuated convertible sofa bed 10*b* further includes first and second ninety-degree angle roller brackets 184 and 185 mounted lengthwise to portions of respective opposing interior sides of the seat frame 16. A first side of each roller bracket is mounted to its respective seat frame interior side such that its first side extends downward and its second side extends inward toward the opposing seat frame interior side. Also included are first and second rollers 187 and 188 mounted to fore edge portions of respective first and second U-shaped legs 135, 137 via respective triangle bracket assemblies 190 and 192. The rolling surface of each of the first and second rollers 187, 188 is adapted to engage the lengthwise edge of the first side of the ninety-degree angle roller brackets 184, 185, respectively, and to a rotate as the seat frame moves in either the forward or rearward direction when the electrically actuated convertible sofa bed moves between the seat and bed positions. In addition to providing support for the seat frame 16 during forward and rearward movement, placement of the first and second rollers 187, 188 enables the convertible sofa bed 10*b* to be electrically adjusted between the reclining and seat position when occupied by a user.

As is also illustrated, the convertible sofa bed 10*b* includes seat stop/retainer brackets 194, 195 mounted to respective triangle bracket assemblies 190 and 192 and adapted to "lock" the seat frame 16 in place, thereby precluding a user from lifting the seat frame 16 and possibly damaging the drive screws 160, 162.

As may be apparent from the above discussion, the convertible sofa bed 10 includes simple yet reliable and sturdy linkage assemblies that provide numerous advantages over previous convertible sofa bed designs. In addition, due to the placement and design of the linkage assemblies, a manufacturer can easily convert a manually actuated convertible sofa bed 10*a* to an electrically actuated convertible sofa bed 10*b*. Further, full length sinuous wire springs in both the back and seat frames provide optimum comfort and support, while the large surface area provided when the convertible sofa bed 10 is in the bed position provides sleeping comfort.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected.

The invention claimed is:

1. A convertible sofa bed (10*a*, 10*b*) comprising:

a seat frame (16);

a back frame (20);

a support structure (26); and a linkage assembly (102, 103) pivotally coupling the seat frame (16) to the back frame (20), and pivotally coupling the seat frame (16) to the support structure (26), and pivotally coupling the back frame (20) to the support structure (26);

said convertible sofa has an electrical drive assembly (144, 146, 148, 150, 152, 160, 162) having a motor (144) mounted to the support structure;

a cable drive (146, 148) rotatably coupled to and extending from the motor (144);

a threaded drive screw (160, 162) having an external thread;

a right angle gear box (150, 152) mounted to an aft portion of the support structure (26), the right angle gear box (150, 152) having a first input rotatably coupled to the cable drive (146, 148) and a second input rotatably coupled to a first end of the threaded drive screw (160, 162), the right angle gear box (150, 152) responsive to the motor (144) to rotate the threaded drive screw (160, 162) in a substantially horizontal plane; and a drive nut assembly mounted to the back carrier link and the threaded drive screw, the drive nut assembly (176, 178) adapted to linearly travel on the threaded drive screw (160, 162) to cause movement of the back carrier link (107, 118) in response to rotation of the threaded drive screw (160, 162).

2. The convertible sofa bed of claim 1, wherein the drive nut assembly (176, 178) travels in a forward direction on the threaded drive screw (160, 162) to move the convertible sofa bed (10*b*) into the bed position (FIG., and wherein the drive nut assembly (176, 178) travels in a rearward direction on the threaded drive screw (160, 162) to move the convertible sofa bed (10*b*) into the seat position (FIG. 1, 8).

3. The convertible sofa (10*b*) of claim 2, wherein the drive nut assembly (176, 178) is comprised of:

a drive nut clevis (179) having a top portion mounted to the flange and a bottom portion adapted to allow the threaded drive screw (160, 162) to pass between two opposing sides of the drive nut clevis (179), each of the two opposing sides of the drive nut clevis having an aligned aperture therethrough; and a drive nut (180) disposed in the aligned apertures and having a crosswise threaded bore therein, the crosswise threaded bore having an internal thread adapted to mate with external thread of the threaded drive screw (160, 162).

4. The convertible sofa of claim 3, further comprising a washer and bolt assembly (181) disposed on a second end of the drive screw (160, 162) to terminate travel of the drive nut assembly (176, 178) in the forward direction.

5. A convertible sofa bed (10*b*) comprising:

a seat frame (16);

a back frame (20);

a support structure (26);

a first and second linkage assembly (102, 103), each of the first and second linkage assemblies (102, 103) pivotally coupling respective first and second sides of the seat frame (16) to respective first and second sides of the back frame (20), and pivotally coupling the first and second sides of the seat frame (16) to respective first and second sides of the support structure (26), and pivotally coupling the first and second sides of the back frame (20) to respective first and second sides of the support structure (26); and an electrical drive assembly (144, 146, 148, 150, 152, 160, 162) coupled to the linkage assembly (102, 103), the electrical drive assembly (144, 146, 148, 150, 152, 160, 162) adapted to cause the convertible sofa bed (10*b*) to move in a forward direction into a seat position and in a rearward direction into a bed position, the electrical drive assembly (144, 146, 148) including:

a motor (144) mounted to the support structure, a first and second cable drive (146, 148) rotatably coupled to and extending from a first and second end of the motor (144), a first and second threaded drive screw (160, 162) having an external thread, a first and second right angle gear box (150, 152), each of the first and second right angle gear boxes (150, 152) mounted to respective first and second aft portions of the support structure (26), each of the first and second right angle gear boxes (150, 152) having a first input rotatably coupled to respective first and second cable drives (146, 148) and a second input rotatably coupled to a first end of respective first and second threaded drive screws, (160, 162) each of the first and second right angle gear boxes (150, 152) responsive to the motor (144) to rotate respective first and second threaded drive screws (160, 162) in a substantially horizontal plane, and a first and second drive nut assembly (179) mounted to respective first and second back carrier links (107, 118) and respective first and second threaded drive screws (160, 162), each of the first and second drive nut assemblies (176, 178) adapted to linearly travel on respective first and second threaded drive screws (160, 162) to cause movement of respective first and second back carrier links (107, 118) in response to rotation of respective first and second threaded drive screws (160, 162).

6. The convertible sofa bed (10*b*) of claim 5, wherein each of the first and second drive nut assemblies (176, 178) comprises:

a drive nut clevis (179) having a top portion mounted to the flange and a bottom portion adapted to allow the threaded screw drive (160, 162) to pass between two opposing sides of the drive nut clevis, each of the two opposing sides of the drive nut clevis having an aligned aperture therethrough; and a drive nut (180) disposed in the aligned apertures and having a crosswise threaded bore therein, the crosswise threaded bore having an internal thread adapted to mate with the external thread of the threaded drive screw (160, 162).

7. The convertible sofa bed (10*b*) of claim 5, further comprising:

a first and second bracket (190, 192) attached to respective first and second bottom side edges of the seat frame (16); and a first and second roller (187, 188) attached to a respective first and second fore corner portion of the support structure (26), the first and second rollers (187, 188) adapted to rollingly engage respective first and second brackets (190, 192) as the convertible sofa bed (10*b*) moves in a forward direction and in a rearward direction.

8. The convertible sofa bed (10*b*) of claim 5 further comprising:

a front kick panel (24), connected to a front kick panel frame, wherein the kick panel frame is slidably connected to the support structure (26).

* * * * *